US008539722B2

(12) United States Patent
Buckenmaier

(10) Patent No.: US 8,539,722 B2
(45) Date of Patent: Sep. 24, 2013

(54) ROOF WATER DISPERSAL SYSTEM

(71) Applicant: Erwine T. Buckenmaier, Westport, CT (US)

(72) Inventor: Erwine T. Buckenmaier, Westport, CT (US)

( * ) Notice: Subject to any disclaimer, the term of this patent is extended or adjusted under 35 U.S.C. 154(b) by 0 days.

(21) Appl. No.: 13/573,589

(22) Filed: Sep. 26, 2012

(65) Prior Publication Data

US 2013/0074422 A1 Mar. 28, 2013

Related U.S. Application Data

(60) Provisional application No. 61/626,367, filed on Sep. 27, 2011.

(51) Int. Cl.
*E04D 13/00* (2006.01)
*E04D 15/00* (2006.01)

(52) U.S. Cl.
USPC ..... 52/97; 52/11; 52/15

(58) Field of Classification Search
USPC ..... 52/11–15, 97
See application file for complete search history.

(56) References Cited

U.S. PATENT DOCUMENTS

| | | | | |
|---|---|---|---|---|
| 1,639,916 | A * | 8/1927 | Wilson | 248/48.2 |
| 2,004,861 | A * | 6/1935 | Feltman | 248/48.2 |
| 2,349,467 | A * | 5/1944 | Scott | 248/48.2 |
| 3,388,555 | A | 6/1968 | Foster | |
| 3,939,616 | A | 2/1976 | Schapker | |
| 4,032,456 | A | 6/1977 | Berce | |
| 4,579,303 | A * | 4/1986 | Midlik | 248/48.2 |
| 4,646,488 | A | 3/1987 | Burns | |
| 4,813,190 | A | 3/1989 | Wittig | |
| 5,261,195 | A | 11/1993 | Buckenmaier et al. | |
| 5,261,196 | A | 11/1993 | Buckenmaier et al. | |
| 5,335,460 | A | 8/1994 | Smith, Jr. | |
| 5,579,611 | A | 12/1996 | Buckenmaier et al. | |
| 6,951,323 | B1 * | 10/2005 | McNichol | 248/48.1 |
| 7,155,864 | B1 | 1/2007 | Din | |
| 7,905,061 | B2 | 3/2011 | Kaiser et al. | |
| 2007/0113489 | A1 * | 5/2007 | Kaiser et al. | 52/84 |

FOREIGN PATENT DOCUMENTS

EP 553061 A1 * 7/1993

OTHER PUBLICATIONS

Machine transalation of Dorta (EP 553,061) by EPO.*

* cited by examiner

*Primary Examiner* — Brian Glessner
*Assistant Examiner* — Brian D Mattei
(74) *Attorney, Agent, or Firm* — Mark P. Stone

(57) ABSTRACT

A roof water dispersal system includes a plurality of longitudinally extending dispersal elements mounted near the edge of a roof structure for receiving and dispersing streams of roof run-off water. The dispersal elements are spaced apart from each other and assembled into a unit to receive streams of roof run-off water, and to disperse the run-off water into droplets or mist to eliminate the erosive effect on the terrain beneath the roof structure which is generally associated with conventional rain gutters. The unit is movable in an upward direction relative to the mounting surface into a retracted storage position, and is vertically movable relative to the roof edge for adjusting the distance between the roof edge and the dispersal elements.

17 Claims, 3 Drawing Sheets

ROOF WATER DISPERSAL SYSTEM

The present application claims the benefit of U.S. Provisional Patent Application No. 61/626,367 filed on Sep. 27, 2011 pursuant to 35 U.S.C. 119(e).

BACKGROUND OF THE INVENTION

The present invention is generally directed to roof water dispersal systems such as those generally disclosed in U.S. Pat. No. 3,939,616 entitled "Roof Water Run-Off Dispersal" issued on Feb. 24, 1976 to Richard L. Schapker; U.S. Pat. No. 4,646,488 entitled "Rain Disperser System" issued to Lawrence C. Burns on Mar. 3, 1987; U.S. Pat. No. 5,261,195 entitled "Roof Water Dispersal System" issued on Nov. 16, 1993 to Erwine T. Buckenmaier and Richard J. Urban; U.S. Pat. No. 5,261,196 entitled "Roof Water Dispersal System" issued on Nov. 16, 1993 to Erwine T. Buckenmaier and Richard J. Urban; and U.S. Pat. No. 5,579,611 entitled "Roof Water Dispersal System" issued on Dec. 3, 1996 to Erwine T. Buckenmaier and Richard J. Urban.

The disclosures of the aforementioned 5 United States patents are expressly incorporated by reference herein.

The roof water dispersal systems disclosed by U.S. Pat. Nos. 5,261,195; 5,261,196; and 5,579,611 include dispersal units formed from a plurality of longitudinally extending dispersal elements or slats which are oriented to extend laterally in a direction substantially parallel to the drip edge of a roof structure. The roof water dispersal assemblies include one or more transverse cross members which intersect and support the lateral slats from below (U.S. Pat. Nos. 5,261,195 and 5,261,196) or from above (U.S. Pat. No. 5,579,611) at a substantially perpendicular orientation for maintaining a predetermined angular orientation and spacing between the individual lateral slats. The assembled disperser unit is mounted either to the roof structure itself or to a vertical wall of a building structure such that the plurality of laterally extending parallel slats are positioned relative to the drip edge of the roof to receive, to deflect, and to disperse streams of run-off water flowing downwardly from the roof. The primary purpose of the roof water dispersal systems disclosed by U.S. Pat. Nos. 5,261,195; 5,261,196; and 5,579,611 is to replace conventional roof gutters, which require continuous maintenance to remove leaves and other debris which accumulate in the channels, and which divert run-off water into relatively large streams which impact against the same area or areas of the underlying terrain resulting in damage and erosive effect. On the contrary, the roof water dispersal systems disclosed by U.S. Pat. Nos. 5,261,195; 5,261,196; and 5,579,611 disperse the streams of roof run-off water into smaller droplets or mist which are dispersed or distributed over a wide range of terrain extending below the entire roof edge, thereby avoiding damage and corrosive effect on the underlying terrain which otherwise would result from the impact of high velocity streams of unimpeded run-off water continuously impacting against the same localized areas beneath the roof edge. Additionally, the roof water dispersal systems in accordance with the three aforementioned patents do not have any channels of the type included in conventional rain gutters, and therefore do not require maintenance to remove leaves and other debris which accumulate in the channels of conventional rain gutters.

The advantages of the roof water dispersal systems of the aforementioned patents, as compared to conventional roof gutters, are extensively discussed in U.S. Pat. Nos. 5,261,195; 5,261,196; and 5,579,611, to which further reference is invited.

The roof water dispersal systems disclosed by U.S. Pat. Nos. 5,261,195; 5,261,196; and 5,579,611 are fixedly mounted relative to the drip edge of a roof. Accordingly, the vertical distance between the drip edge of the roof and the lateral slats or dispersal elements is fixed and non-adjustable. Additionally, the angle of the dispersal unit relative to the mounting surface is fixed and non-adjustable.

It is the primary object of the present invention to provide a roof water dispersal system, of the type disclosed by U.S. Pat. Nos. 5,261,195; 5,261,196; and 5,579,611, in which the vertical distance between the dispersal elements or slats and the drip edge of the roof is selectively adjustable.

It is a further object of the present invention to provide a roof water dispersal system of the type disclosed by U.S. Pat. Nos. 5,261,195; 5,261,196; and 5,579,611 in which the angle of the roof water dispersal unit relative to the mounting surface is selectively adjustable so as to be upwardly movable into a retracted storage position.

Although conventional roof gutters are known to be rotatable, such roof gutters are rotatable only in a downwardly direction relative to the mounting surface for the primary purpose of facilitating the cleaning of the roof gutters to remove leaves and other debris accumulated in the channels. See, for example, U.S. Pat. No. 5,335,460 which provides means for tilting a gutter in a downward direction for the purpose of cleaning the gutter. See also U.S. Pat. No. 4,813,190 which also discloses a system for tilting the channel of a roof gutter in a downward direction for the purpose of both removing debris from the gutter and for moving the downwardly directed roof gutter into a position beneath the overhang of a roof for storage and winter protection. These prior art references are designed to tilt the gutter only in a downward direction to enable gravitational forces to assist in the removal of debris from the channels. However, the references fail to suggest movement of a roof water dispersal system of the type disclosed by U.S. Pat. Nos. 5,261,195; 5,261,196; and 5,579,611, which do not require cleaning of debris from channels of gutters because such units eliminate channels or gutters. U.S. Pat. Nos. 5,335,460 and 4,813,190 also fail to suggest roof water dispersal systems of the type disclosed by U.S. Pat. Nos. 5,261,195; 5,261,196; and 5,579,611 in which the vertical distance between the dispersal elements or slats and the drip edge of a roof is adjustable, or the advantages resulting therefrom, as will be more fully discussed herein.

U.S. Pat. Nos. 3,388,555; 4,032,456; 7,155,864; and 7,905,061 generally illustrate known gutters or other roof water dispersal systems different from the type of roof water dispersal systems disclosed by U.S. Pat. Nos. 5,261,195; 5,261,196; and 5,579,611.

SUMMARY OF THE INVENTION

A roof run-off water dispersal system includes a plurality of generally longitudinally extending lateral disperser elements or slats oriented substantially parallel to a drip edge of a roof structure, and mounted relative to the roof structure to receive streams of roof run-off water from the drip edge of the roof. The dispersal elements are supported and maintained at a predetermined spacing relative to each other, and at a predetermined angle of inclination relative to the horizontal, by one or more transverse or cross members intersecting the lateral slats in a substantially perpendicular direction. The transverse or cross-members are arranged to support the dispersal elements from below, or in the alternative, the transverse or cross-members are arranged to support the dispersal elements from above.

The dispersal unit including the dispersal elements or slats and the supporting transverse or cross members is mounted to a supporting surface of a building or house such that the vertical distance between the edge of the roof and the dispersal elements is adjustable. The distance between the drip edge of the roof and the dispersal elements effects the dispersal characteristics of the roof water dispersal system—namely, the efficiency at which the streams of roof run-off water are dispersed into smaller droplets or mists and distributed over a wide range of area of the terrain disposed beneath the dispersal unit. Accordingly, the distance between the dispersal elements of the dispersal unit and the drip edge of a roof is selectively adjustable to optimize the dispersal characteristic for any given installation of the roof water dispersal system by adjusting the distance and speed at which the run-off water impacts the dispersal elements.

The roof water dispersal system also enables the lateral slats and the cross members of the dispersal unit to be selectively moved from a substantially horizontal extending operating position, upwardly into a retracted storage position against a supporting surface on the house or building to which the dispersal unit is mounted. In this manner, the dispersal unit can be selectively moved into its compact retracted storage position to avoid damage thereto resulting from inclement weather conditions. By enabling the dispersal unit to be selectively moved only in an upward direction into its retracted position, protection for the dispersal elements and slats is provided as a result of the close contact between the dispersal unit and the surface of the building or house which the dispersal unit contacts in its compact storage position. Additionally, by enabling the dispersal unit to move only in an upward direction, the dispersal unit is prevented from falling to the ground below in the event that a locking mechanism for maintaining the dispersal unit in its horizontally extending position fails, or rotating downwardly and becoming totally ineffective as with downwardly rotating conventional gutters.

In the preferred embodiment of the invention, the selective adjustment of the distance between the edge of the roof and the dispersal unit, and the selective movement of the dispersal unit into its compact retracted storage position, is provided by an adapter which is mounted to the structure of the house or building and which also retains the dispersal unit.

DESCRIPTION OF THE BEST MODES FOR CARRYING OUT THE INVENTION

Figure 1:
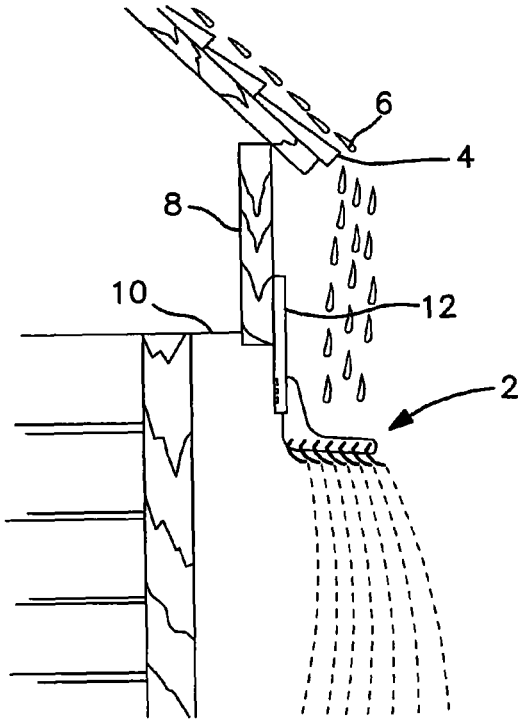
FIG. 1 of the drawing illustrates a schematic view of the roof water dispersal system in accordance with the present invention mounted beneath a roof of a structure in its extended operating position.

FIG. 1 of the drawing schematically illustrates the roof water dispersal system in accordance with the present invention in its extended operating position. The dispersal unit, generally designated by reference numeral 2, is mounted beneath the drip edge of a roof, generally designated by reference numeral 4, so that the flow of roof water, generally designated by reference numeral 6, strikes the dispersal unit and is dispersed into smaller droplets or mist which is distributed along a wide area of terrain beneath the roof. The dispersal unit 2 is mounted to the fascia board, designated by reference numeral 8, of a building structure generally designated by reference numeral 10. The dispersal unit 2 is mounted to the fascia board 8 by an adapter unit generally designated by reference numeral 12 which is disposed between the building structure and the dispersal unit. As will be discussed herein, the adapter unit 12 enables the vertical distance between the edge of the roof 4 and the dispersal unit 2 to be selectively adjusted, and also enables the dispersal unit 2 to be selectively moved into a compact retracted storage position.

Figure 2:
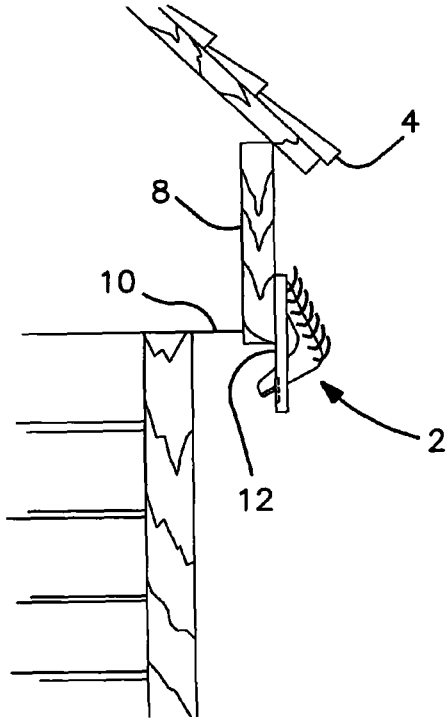
FIG. 2 of the drawing illustrates the roof water dispersal system shown in FIG. 1 in its retracted storage position.

FIG. 2 is similar to FIG. 1, except that the dispersal unit 2 is now shown in its compact retracted storage position. As illustrated, the dispersal unit has been moved upwardly and is facing towards the building structure.

Figure 3:
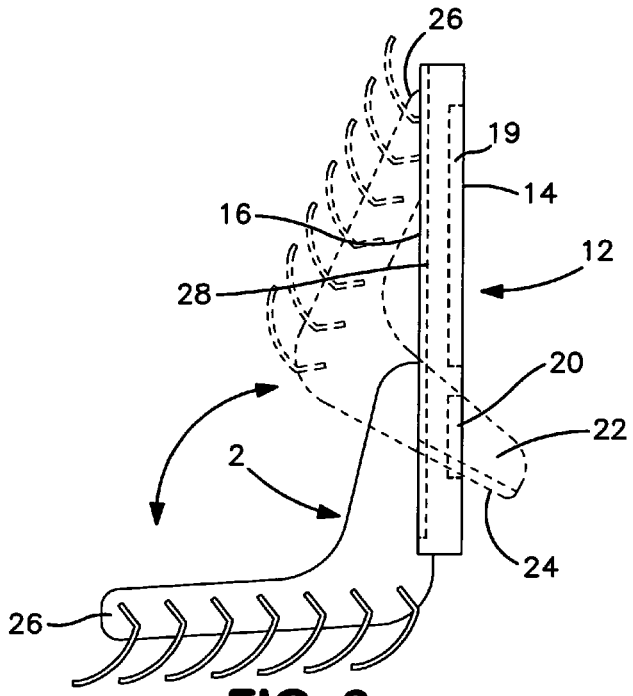
FIG. 3 illustrates a dispersal element in both an extended operating position and a compact retracted storage position, and an adapter element in accordance with the present invention.

FIGS. 3 and 4A-C illustrate the adapter unit 12, generally shown in FIGS. 1 and 2, in greater detail. FIG. 3 also illustrates the adapter unit 12 with the dispersal unit 2 in both the extended operating position and the retracted storage position. The adapter unit 12 has both a rear wall generally designated by reference numeral 14 and a front wall generally designated by reference numeral 16. The upper portion of the rear wall 14 of the adapter 12 defines a centrally positioned longitudinally extending slot designated by reference numeral 19 as best illustrated by FIG. 4. The slot 19 has a width less than that of the heads of a mounting screw designated by reference numeral 21 but larger than the thread of the mounting screw to receive the thread of the mounting screw 21 for mounting the upper portion of the rear wall 14 of the adapter unit 12 to the fascia board 8 (FIGS. 1 and 2) of the building structure. Reference numeral 18 represents markers on the adapter indicating the preferred locations for the mounting screws. As will be apparent to persons skilled in the relevant art, the vertical distance between the dispersal unit and the drip edge of the roof can be selectively adjusted by inserting the mounting screws through different positions along the continuously extending slot 19. Theoretically, an infinite number of mounting positions are provided within the predetermined range defined by the length of the slot 19. As illustrated by FIG. 4, the selective adjustment to the vertical distance between the dispersal unit 2 and the edge of the roof 4 is adjustable to any different vertical level defined by the length of the slot 19 in the upper portion of the rear wall 14 of the adapter unit 12.

In the alternative, the slot 19 in the rear wall of the adapter can be replaced by two or more openings for receiving mounting screws. However, providing openings for the mounting screws instead of the continuous slot 19 is significantly less desirable than the continuous slot 19 because the adjustment positions of the adapter are limited to only the positions corresponding to the mounting openings.

Preferably, the upper portion of the rear wall 14 of the adapter unit 12 defining the longitudinal mounting slot 19 will be at least half the length of the rear wall 14 of the adapter unit 12 to provide a relatively large range of adjustment of the vertical distance between the roof edge and the dispersal unit.

Figure 4:
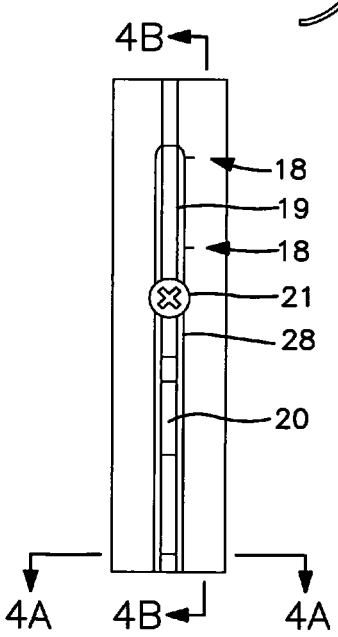
FIG. 4 illustrates a front elevational view, partially in section, of the adapter illustrated by FIG. 3.

As illustrated by FIGS. 3 and 4, the lower portion of the rear wall 14 of the adapter unit 12 defines a slot designated by reference numeral 20. As best illustrated by FIG. 3 of the drawing, the slot 20 is positioned to receive the rear portion 22 of the dispersal unit 2 when the dispersal unit is moved upwardly into its retracted storage portion. Thus, the width of the slot 20 must be at least slightly greater than the width of the rear portion 22 of the dispersal unit 2 so that the rear portion 22 can be received within the slot 20.

The rear portion 22 of the dispersal unit 2 also includes a flange designated by reference numeral 24. The flange helps to removably retain the dispersal unit 2 in its storage position when the rear end 22 of the dispersal unit is received within the slot 20. As also illustrated by FIG. 3, the front tip 26 of the dispersal unit 2 engages an upper portion of the front wall 16 of the adapter when the dispersal unit is moved upwardly into its storage position. The engagement of the front tip 26 of the dispersal unit against the front wall 16 of the adapter unit 12 further assists in maintaining the dispersal unit in its storage position as a result of frictional engagement between the tip 26 of the dispersal unit 2 and the top of the front wall 16 of the adapter unit 12. Additionally, a notch or small slot can be defined on the portion of the front wall 16 of the adapter engaged by the tip 26 when the dispersal unit 2 is moved upwardly into its full retracted storage position as illustrated by FIG. 3.

Thus, it is apparent that the dispersal unit 2 is removably retained in its retracted storage position by three separate means—the rear end 22 and flange 24 received in the slot 20 defined in the rear wall 14 of the adapter unit; the engagement of the tip 26 of the dispersal unit against the upper surface of the front wall 16 of the adapter unit; and gravitational forces acting upon the dispersal unit 2 when it is moved into its retracted storage position within the adapter unit 12.

The front wall 16 of the adapter unit 12 defines a central longitudinal slot designated by reference numeral 28 which extends substantially throughout the full length of the front wall. The front slot 28 serves two separate functions. First, it receives a portion of the dispersal unit 2 as it is being moved into its retracted position as illustrated by FIG. 3. Secondly, the width of the front slot 28 is greater than the head of the mounting screws so that the mounting screws pass through the front slot 28 to engage the mounting slot 19 in the rear wall 14 to mount the adapter to the fascia board. As noted above, the width of the mounting slot 19 is greater than the width of the threads of the mounting screws but less than the width of the heads of the mounting screws.

Figure 4A:
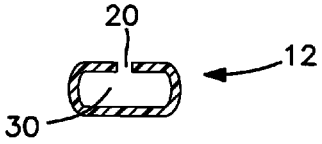
FIG. 4A illustrates a sectional view of the adapter of FIG. 4, taken along directional arrows 4A of FIG. 4.
Figure 4B:
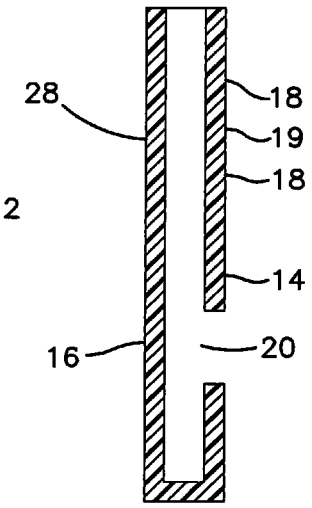
FIG. 4B illustrates a sectional view of the adapter of FIG. 4 taken along directional arrows 4B of FIG. 4.

The dispersal unit 2 is maintained in its extended operating position by the configuration of the adapter unit 12. As best illustrated by FIG. 4A, the adapter unit 12 generally defines a substantially closed channel designated by reference numeral 30, and the bottom of the adapter is defined by a closed bottom surface. In the extended operating position of the dispersal unit 2, the flange 24 engages the closed bottom surface of the adapter, and is held in that position by gravitational forces. Accordingly, the closed bottom surface of the adapter unit 12 acts as a stop, together with gravitational forces acting on the dispersal unit 2, retains the dispersal unit 2 in its extended operating position as illustrated by FIG. 3.

When moving the dispersal unit 2 from its extended operating position into its retracted storage position, the dispersal unit is first moved a predetermined distance upwardly in the channel defined by the adapter, and thereafter tilted rearwardly through the front slot 28 in the front wall 16 of the adapter so that the rear portion 22 and the flange 24 of the dispersal unit 2 extending through the lower 20 in the rear wall 14 of the adapter as illustrated by FIG. 3.

Figure 5:
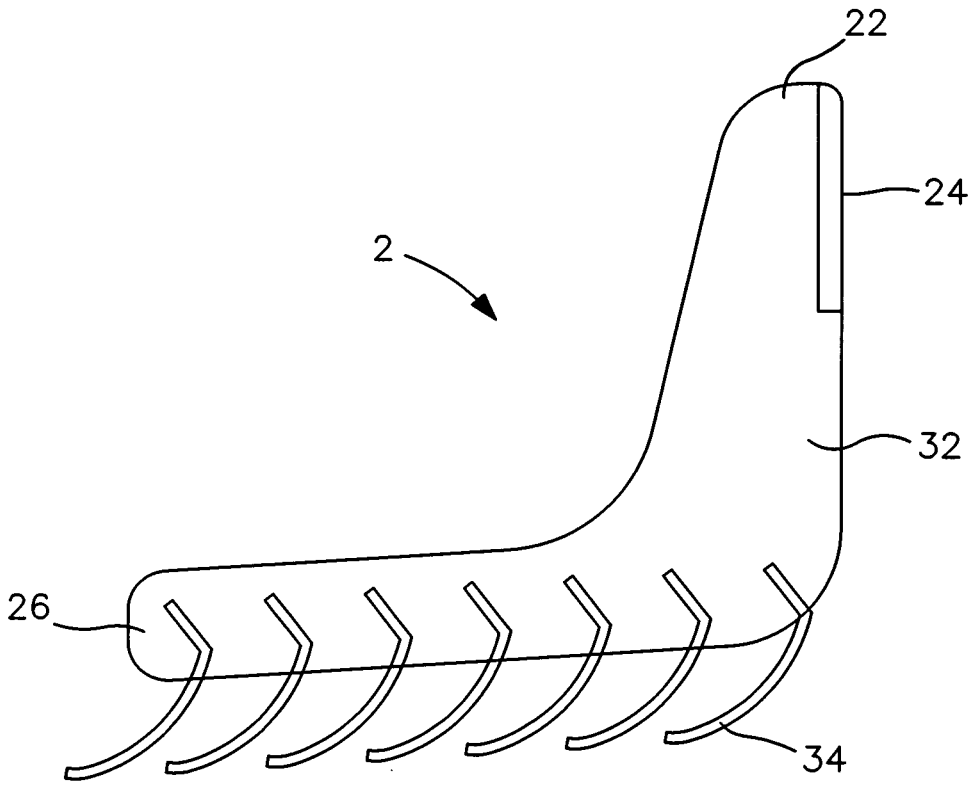
FIG. 5 illustrates the dispersal element shown in FIG. 3 removed from the adapter.

FIG. 5 illustrates the dispersal unit 2, separated from the adapter unit 12. The dispersal unit includes the supporting element generally designated by reference numeral 32, and a plurality of slats 34 which extend longitudinally below the roof 4. The orientation of the dispersal element 34 is more fully discussed in the aforementioned prior art references, in which the dispersal elements 34 can be supported from above or below the supporting element 32. FIG. 5 also illustrates the flange 24 defined on the rear portion 22 of the dispersal unit 2 for assisting in removably retaining the dispersal unit 2 in its compact/retracted storage position, as illustrated by FIG. 3.

In operation, the improvement to roof water dispersal systems disclosed herein enables the vertical distance between the roof and the roof water dispersal unit to be selectively and continuously adjustable between an infinite number of positions, within a predetermined range defined by the length of the adjustment slot, by the user or installer. As discussed herein, the distance between the drip edge of a roof and the dispersal unit is the most significant factor in the dispersion characteristic of the dispersal unit. The greater the vertical distance between the drip edge of a roof and the dispersal unit, the better the dispersion characteristic will be—e.g., the conversion of the stream of run-off water into small droplets or mist, and the wider range of dispersion of the small droplets or mist over the terrain below. By permitting the selective and continuous adjustment of the vertical distance between the roof edge and the dispersal unit within a predetermined range of adjustment, the installer may optimize the dispersion characteristic by maximizing the vertical distance between the roof edge and the dispersal unit, yet a range of adjustment is also available to the installer to meet specific needs of a particular installation. On the contrary, the vertical distance between the drip edge of a roof and a dispersal unit in the aforementioned known roof water dispersal systems is fixed at a predetermined distance upon installation.

Experience has shown that a drop of 6 inches or more is desirable for satisfactory dispersion. Accordingly, depending on the fascia configuration, the installer can make a vertical adjustment to reach or exceed a 6 inch drop.

The improvement to the roof water dispersal system in accordance with the present invention also enables the dispersal unit to be selectively and removably moved upwardly into a compact/retracted storage position by the user. Movement into the retracted storage position would normally occur, for example, in advance of severe inclement weather conditions which might otherwise damage or destroy the dispersal unit which is extended outwardly in its normal operating position. The structure and structural arrangement of the dispersal unit in accordance with the preferred embodiment of the invention as discussed herein enables movement of the dispersal unit into the retracted storage position without a hinge, thereby simplifying the structure and reducing the cost. Of course, it is within the scope of the invention to also provide a hinge or other known means for moving or rotating the dispersal unit into the storage position.

Moreover, in the preferred embodiment of the dispersal system as disclosed herein, the dispersal unit is only moveable in an upward direction between its extended operating position and compact storage position. Since there is no accumulation of leaves or debris in the roof water dispersal system of the type to which the present invention is directed, it will never be necessary to rotate the dispersal unit downwardly for cleaning purposes. By avoiding rotation of the dispersal unit in the downward direction, the structure and structural arrangement of the dispersal unit is simplified, and less wear is incurred since the dispersal unit is only moveable within a limited range in the upward direction.

Although the preferred embodiment of the present invention employs an adapter unit for selectively adjusting the vertical distance between the roof edge and the dispersal unit, and for selectively moving the dispersal unit upwardly into a compact/retracted storage position, other conventional means for height adjustment and movement into a compact storage position can be employed in the present invention. For example, a lift driven by electrical, mechanical or hydraulic means could be employed to adjust the vertical distance between the roof edge and the dispersal unit. Similarly, the dispersal unit can be rotatably mounted relative to the fascia board of the building structure, either by mechanical, electrical or hydraulic. However, the adapter unit in accordance with the preferred embodiment of the present invention simplifies both the structure and structural arrangement, and avoids the expense and complexity of providing additional mechanical components and electrical devices for performing the function of adjusting the vertical distance between the roof edge and the dispersal unit, and moving the dispersal unit between an extended operating position and a compact storage position.

Other modifications and advantages within the scope of the invention disclosed herein will become apparent to those skilled in the relevant art. Accordingly, the discussion of the preferred embodiment of the invention disclosed herein is intended to be illustrative only, and not restrictive of the scope of the invention, that scope being defined by the following claims and all equivalents thereto.

The invention claimed is:

1. A roof water dispersal system comprising at least one substantially longitudinally extending dispersal element oriented relative to the edge of a roof so as to receive roof run-off water thereon, a supporting element for supporting said at least one dispersal element relative to the edge of the roof, and means for selectively moving said at least one dispersal element between an extended operating position and a retracted storage position, wherein said means for selectively moving said at least one dispersal element between said extended operating position and said retracted storage position comprises an adapter element, said adapter element having a front wall with a substantially longitudinally extending slot defined in a portion thereof, and a rear wall with a substantially longitudinally extending slot defined in a portion thereof, said slots in said front and rear walls of said adapter element being dimensioned so as to receive at least a portion of said supporting element for said at least one dispersal element when said dispersal element is moved from said extended operating position into said retracted storage position.

2. The roof water dispersal system as claimed in claim 1, wherein said means for moving said dispersal element from said extended operating position into said retracted storage position is arranged to permit movement of said at least one dispersal element only in an upward direction.

3. The roof water dispersal system as claimed in claim 1, wherein said portion of said supporting element received in said slot in said rear wall of said adapter defines a flange for removeably retaining said supporting element in said slot in said rear wall of said adapter element when said at least one roof water dispersal element is in said retracted storage position.

4. The roof water dispersal system as claimed in claim 1, wherein a portion of said front wall of said adapter element is notched to receive a portion of said supporting element when said at least one dispersal element is in said retracted storage position.

5. A roof water dispersal system comprising at least one substantially longitudinally extending dispersal element oriented relative to the edge of a roof so as to receive run-off water thereon, a supporting element for supporting said a least one dispersal element relative to the edge of the roof, means for selectively adjusting the vertical distance between said at least one dispersal element and the edge of the roof within predetermined limits, and means for selectively moving said at least one dispersal element between an extended operating position and a retracted storage position, wherein said means for selectively moving said at least one dispersal element between said extended operating position and said retracted storage position comprises an adapter element, said adapter element having a front wall with a substantially longitudinally extending slot defined in a portion thereof, and a rear wall with a substantially longitudinally extending slot defined in a portion thereof, said slots in said front and rear walls of said adapter element being dimensioned so as to receive at least a portion of said supporting element for said at least one dispersal element when said dispersal element is moved from said extended operating position into said retracted storage position.

6. The roof water dispersal system as claimed in claim 5, wherein said means for moving said dispersal element from said extended operating position into said retracted storage position is arranged to permit movement of said at least one dispersal element only in an upward direction.

7. The roof water dispersal system as claimed in claim 5, wherein said means for selectively adjusting the vertical distance between said at least one dispersal element and the edge of the roof includes an adapter element, said adapter element comprising a rear wall defining a substantially longitudinally extending mounting slot defined along at least a portion of said rear wall for mounting the adapter element to at least two separate positions at two different vertical distances from the roof edge, said adapter further including structure for retaining thereon said supporting element for said at least one dispersal element.

8. The roof water dispersal system as claimed in claim 7, wherein said adapter element defines a substantially closed channel having a closed bottom portion.

9. The roof water dispersal system as claimed in claim 5, wherein said means for selectively adjusting the vertical distance between said at least one dispersal element and the edge of the roof includes an adapter element, said adapter element comprising a rear wall defining a substantially longitudinally extending mounting slot defined along at least a portion of said rear wall for mounting the adapter element to at least two separate positions at two different vertical distances from the roof edge, said adapter further including structure for retaining thereon said supporting element for said at least one dispersal element.

10. The roof water dispersal system as claimed in claim 9, wherein said adapter element defines a substantially closed channel having a closed bottom portion.

11. The roof water dispersal system as claimed in claim 5, wherein said means for selectively adjusting the vertical distance between said at least one dispersal element and the edge of the roof comprises an adapter element, said adapter element including a rear wall defining at least two openings therein for mounting the adapter element to at least two separate positions at different vertical distances from the edge of the roof, said adapter further including structure for retaining thereon said supporting element for said at least one dispersal element.

12. The roof water dispersal system as claimed in claim 11, wherein said adapter element defines a substantially closed channel having a closed bottom portion.

13. The roof water dispersal system as claimed in claim 5, wherein said means for selectively adjusting the vertical distance between said at least one dispersal element and the edge of the roof comprises an adapter element, said adapter element including a rear wall defining at least two openings therein for mounting the adapter element to at least two separate positions at different vertical distances from the edge of the roof, said adapter further including structure for retaining thereon said supporting element for said at least one dispersal element.

14. The roof water dispersal system as claimed in claim 13, wherein said adapter element defines a substantially closed channel having a closed bottom portion.

15. The roof water dispersal system as claimed in claim 5, wherein said portion of said supporting element received in said slot in said rear wall of said adapter defines a flange for removably retaining said supporting element in said slot in said rear wall of said adapter element when said at least one roof water dispersal element is in said retracted storage position.

16. The roof water dispersal system as claimed in claim 5, wherein a portion of said front wall of said adapter element is notched to receive a portion of said supporting element when said at least one dispersal element is in said retracted storage position.

17. A roof water dispersal system comprising at least one substantially longitudinally extending dispersal element oriented relative to the edge of a roof so as to receive run-off water thereon, a supporting element for supporting said a least one dispersal element relative to the edge of the roof, means for selectively adjusting the vertical distance between said at least one dispersal element and the edge of the roof within predetermined limits, and means for selectively moving said at least one dispersal element between an extended operating position and a retracted storage position, wherein said means for selectively adjusting the vertical distance between said at least one dispersal element and the edge of the roof and said means for selectively moving said at least one dispersal element between said extended operating position and said retracted storage position comprises an adapter element having front and rear walls for retaining therein a portion of said supporting element for said at least one dispersal element, said rear wall of said adapter element adapted to be moveably mounted relative to the edge of the roof for selectively adjusting the vertical distance between said at least one dispersal element and said edge of said roof, said front and rear walls of said adapter element defining slots therein for receiving at least a portion of said supporting element when said at least one dispersal element is moved from said extended operating position into said retracted storage position.

* * * * *

UNITED STATES PATENT AND TRADEMARK OFFICE

CERTIFICATE OF CORRECTION

PATENT NO. : 8,539,722 B2
APPLICATION NO. : 13/573589
DATED : September 24, 2013
INVENTOR(S) : Erwine T. Buckenmaier It is certified that error appears in the above-identified patent and that said Letters Patent is hereby corrected as shown below:

In the Claims

Column 7, Line 65: Delete "a" (second occurrence), and substitute --at--.

Column 9, Line 24: Delete "a" (second occurrence), and substitute --at--.

Signed and Sealed this
Fifth Day of November, 2013

Teresa Stanek Rea

Teresa Stanek Rea
*Deputy Director of the United States Patent and Trademark Office*